US009379470B2

(12) United States Patent
Glick et al.

(10) Patent No.: US 9,379,470 B2
(45) Date of Patent: Jun. 28, 2016

(54) FEMALE ELECTRICAL CONNECTOR WITH TERMINAL ARM EXTENSION PROTECTION

(71) Applicant: Lear Corporation, Southfield, MI (US)

(72) Inventors: Michael Glick, Farmington Hills, MI (US); Tulasi Sadras-Ravindra, Canton, MI (US); Bhupinder Rangi, Novi, MI (US)

(73) Assignee: Lear Corporation, Southfield, MI (US)

( * ) Notice: Subject to any disclaimer, the term of this patent is extended or adjusted under 35 U.S.C. 154(b) by 3 days.

(21) Appl. No.: 14/179,076

(22) Filed: Feb. 12, 2014

(65) Prior Publication Data

US 2014/0235113 A1 Aug. 21, 2014

Related U.S. Application Data

(60) Provisional application No. 61/864,150, filed on Aug. 9, 2013, provisional application No. 61/766,058, filed on Feb. 18, 2013.

(51) Int. Cl.
*H01R 13/11* (2006.01)
*H01R 13/18* (2006.01)

(52) U.S. Cl.
CPC ..... *H01R 13/114* (2013.01); *H01R 13/18* (2013.01)

(58) Field of Classification Search
CPC ..... H01R 13/112; H01R 4/48; H01R 13/18; H01M 2/1005; H01M 2/204
USPC ..... 439/839, 834, 474, 82, 851, 856, 852
See application file for complete search history.

(56) References Cited

U.S. PATENT DOCUMENTS

| | | | | |
|---|---|---|---|---|
| 5,080,604 | A | 1/1992 | Rider et al. | |
| 5,362,244 | A * | 11/1994 | Hanson et al. | 439/82 |
| 5,664,972 | A * | 9/1997 | Zinn | H01R 13/113 439/839 |
| 6,186,841 | B1 * | 2/2001 | Jacobsson | 439/851 |
| 6,955,569 | B2 * | 10/2005 | Baker et al. | 439/839 |
| 7,578,694 | B2 | 8/2009 | Takahashi et al. | |
| 7,892,050 | B2 * | 2/2011 | Pavlovic et al. | 439/839 |
| 7,988,481 | B2 | 8/2011 | Bethurum et al. | |
| 2006/0040555 | A1 | 2/2006 | Chen et al. | |

* cited by examiner

*Primary Examiner* — Tulsidas C Patel
*Assistant Examiner* — Marcus Harcum
(74) *Attorney, Agent, or Firm* — MacMillan, Sobanski & Todd, LLC

(57) ABSTRACT

A female electric connector includes a terminal body with a plurality of terminal arms. The terminal arms extend from the terminal body around a terminal axis. The female electric connector includes an over-deflection protection that limits deflection of the terminal arms in an inward direction generally toward the terminal axis.

20 Claims, 4 Drawing Sheets

FEMALE ELECTRICAL CONNECTOR WITH TERMINAL ARM EXTENSION PROTECTION

CROSS-REFERENCE TO RELATED APPLICATIONS

This application claims the benefit of U.S. Provisional Application No. 61/766,058, filed Feb. 18, 2013, and U.S. Provisional Application No. 61/864,150, filed Aug. 9, 2013, the disclosures of which are both incorporated herein by reference.

BACKGROUND OF THE INVENTION

This invention relates in general to an electric connector and, more specifically, to a female electric connector that includes protection against inward extension of terminal arms.

Electric connectors may be used in a variety of electrical applications, for example, in completing electrical circuits with components in a power distribution box or connecting a wiring harness to an electrical device. These electric connectors may include a female connector that includes multiple flexible terminal arms and a male connector that is inserted into the female connector between the terminal arms. The male connector engages the terminal arms and pushes them outwardly, establishing electric communication between the female connector and the male connector. The terminal arms are moved during normal insertion of the male connector. It would be advantageous to have a female contact that limits the movement of the terminal arms.

SUMMARY OF THE INVENTION

This invention relates to a female electric connector. The female electric connector may include a terminal body. The female electric connector may include a plurality of terminal arms. The terminal arms may extend from the terminal body around a terminal axis. The female electric connector may include an over-deflection protection that limits deflection of the terminal arms in an inward direction. The inward direction may be generally toward the terminal axis. The over-deflection protection may comprise a pair of opposed tabs. The opposed tabs may extend from adjacent terminal arms. Each tab may define a tab engagement surface. The tab engagement surfaces of the opposed tabs may be generally parallel to each other. The tab engagement surfaces of the opposed tabs may be separated by a tab space. The over-deflection protection may not limit the movement of the terminal arms in an outward direction. The outward direction may be generally away from the terminal axis. The female electric connector may include a terminal body having a first side, a second side, a third side, and a fourth side. The female electric connector may include a first terminal arm extending from the first side. The female electric connector may include a second terminal arm extending from the second side. The female electric connector may include a third terminal arm extending from the third side. The female electric connector may include a fourth terminal arm extending from the fourth side. The terminal axis may be located between the first terminal arm and the second terminal arm. The terminal axis may be located between the third terminal arm and fourth terminal arm. A first opposed arm line may be perpendicular to the terminal axis and pass through the first terminal arm and the second terminal arm. A second opposed arm line may be perpendicular to the terminal axis and passes through the third terminal arm and the fourth terminal arm. The first opposed arm line may be generally perpendicular to the second opposed arm line.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
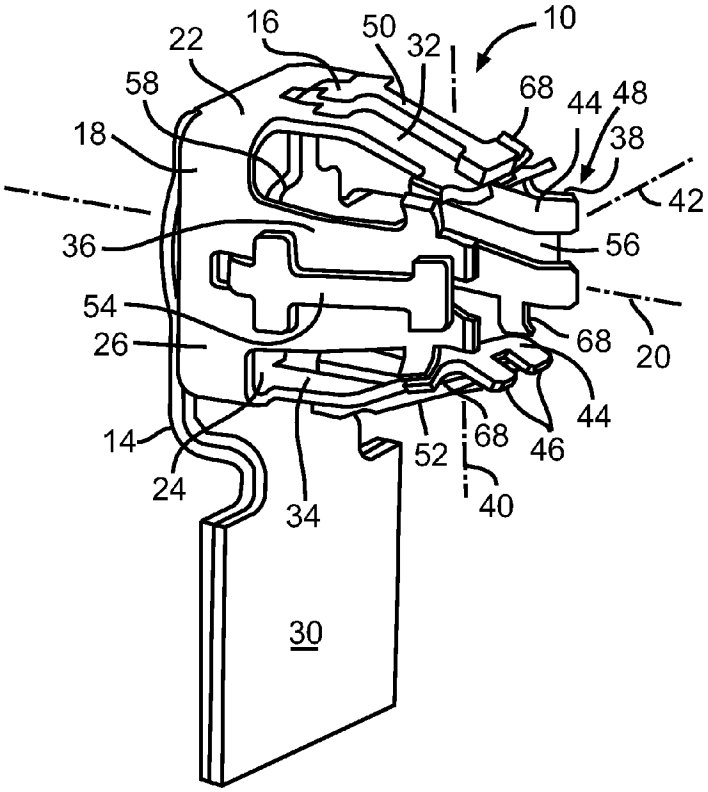
FIG. 1 is a perspective view of a female electric connector with extension protection tabs.

Referring to the drawings, there is shown in FIG. 1 a female electric connector, indicated generally at 10. The female electric connector 10 is configured to mate with a corresponding male pin terminal 12, shown in FIG. 4, to create an electrical connection. The female electric connector 10 and the male pin terminal 12 may be enclosed in respective housings (not shown) and are suitable for use in situations in which it is desirable to have a separable electrical connection. Referring back to FIG. 1, the female electric connector 10 includes a terminal base 14 and an optional clamp 16.

The illustrated terminal base 14 is made of an electrically-conductive material, such as copper, but the terminal base 14 may be made of any desired material. The illustrated terminal base 14 is made from a single piece of sheet metal stamped and folded into the illustrated shape. However, the terminal base 14 may be made from more than one piece of material and may be made by any desired method. Further, the particular shape of the terminal base 14 may be different from that illustrated, if desired.

The terminal base 14 includes a terminal body 18. The terminal body 18 has a generally square box shape centered on a terminal axis 20 that is generally perpendicular to sides 22, 24, 26, and 28 of the body. A termination area 30 extends from the terminal body 18. An electrically-conductive wire (not shown) may be attached to the termination area 30.

Figure 2:
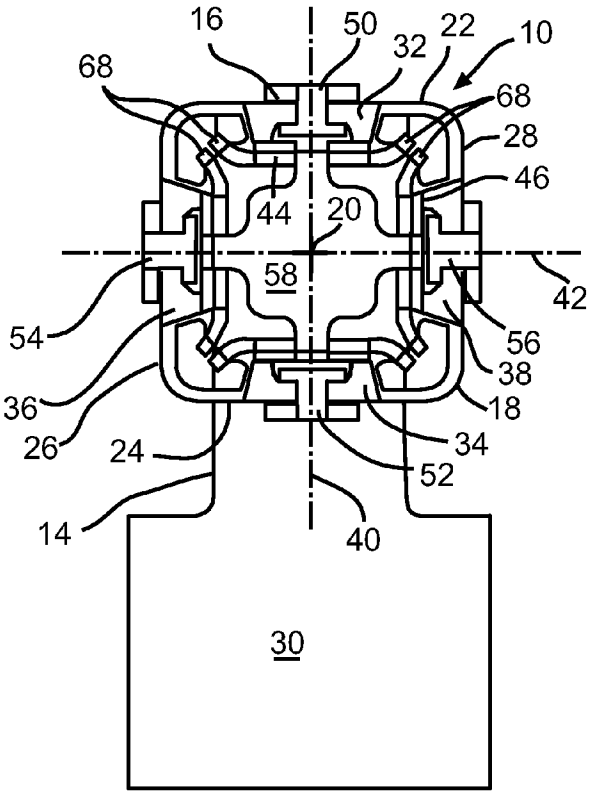
FIG. 2 is a front elevational view of the female electric connector from FIG. 1.

The terminal base 14 includes a first pair of terminal arms 32 that extend from the first side 22 of the terminal body 18 and a second pair of terminal arms 34 that extend from the second side 24 of the terminal body 18. The terminal axis 20 is located between the first pair of terminal arms 32 and the second pair of terminal arms 34. The terminal base 14 also includes a third pair of terminal arms 36 that extend from the third side 26 of the terminal body 18 and a fourth pair of terminal arms 38 that extend from the fourth side 28 of the terminal body 18. The terminal axis 20 is located between the third pair of terminal arms 36 and the fourth pair of terminal arms 38. Referring to FIG. 2, a first opposed arm line 40 is shown that is perpendicular to the terminal axis and passes through the center of the first pair of terminal arms 32 and the center of the second pair of terminal arms 34. Also, a second opposed arm line 42 is shown that is perpendicular to the terminal axis and passes through the center of the third pair of terminal arms 36 and the center of fourth pair of terminal arms 38. As shown, the first opposed arm line 40 is generally perpendicular to the second opposed arm line 42. Although the illustrated female electric connector 10 includes pairs of terminal arms extending from the sides of the terminal body 18, it should be appreciated that each side may have a different number of terminal arms extending from it, if desired. Further, it should be appreciated that the female electric connector 10 may have any desired number of terminal arms.

Each of the terminal arms 32, 34, 36, and 38 includes a respective contact area 44. As the terminal arms 32, 34, 36, and 38 extend from the terminal body 18, they extend in an inward direction, generally toward the terminal axis 20, up to the contact areas 44. The contact areas 44 include the portions of the terminal arms 32, 34, 36, and 38 that are closest to the terminal axis 20 and are the portions of the terminal arms 32, 34, 36, and 38 that will be engaged with the male pin terminal 12. The terminal arms 32, 34, 36, and 38 extend past the contact areas 44 and extend in an outward direction, generally away from the terminal axis 20, to respective terminal arm ends 46. It should be appreciated that contact areas 44 of the first pair of terminal arms 32, the second pair of terminal arms 34, the third pair of terminal arms 36, and the fourth pair of terminal arms 38 define a generally square-shaped pattern, as best shown in FIG. 2. The female electric connector 10 may include an arrangement of terminal arms 32, 34, 36, and 38 that defines contact areas 44 having some other desired shape.

A channel, indicated generally at 48, is defined between the first pair of terminal arms 32, the second pair of terminal arms 34, the third pair of terminal arms 36, and the fourth pair of terminal arms 38. The terminal axis 20 is located within the channel 48. When the male pin terminal 12 is mated with the female electric connector 10, it is inserted into the channel 48. When the male pin terminal 12 is mated with the female electric connector 10, the terminal arms 32, 34, 36, and 38 will be pushed in an outward direction, generally away from the terminal axis 20.

The clamp 16 includes a first clamp arm 50 on the first side 22 of the terminal body 18, a second clamp arm 52 on the second side 24 of the terminal body 18, a third clamp arm 54 on the third side 26 of the terminal body 18, and a fourth clamp arm 56 on the fourth side 28 of the terminal body 18. The clamp arms 50, 52, 54, and 56 are connected by a clamp center 58 that is located within a space defined by the terminal body 18. The illustrated clamp 16 is made of an electrically-conductive material, but may be made of any desired material. The illustrated clamp 16 is made from a single piece of sheet metal that is stamped and folded into the illustrated shape. However, the clamp 16 may be made from more than one piece of material and may be made by any desired method. Each of the clamp arms 50, 52, 54, and 56 engages one of the pairs of terminal arms 32, 34, 36, and 38 and helps to bias the respective pair of terminal arms 32, 34, 36, and 38 in the inward direction, generally toward the terminal axis 20. The clamp 16 serves to help the terminal base 14 maintain contact with the male pin terminal 12. The clamp 16 may have a shape different from that illustrated, if desired.

Figure 4:
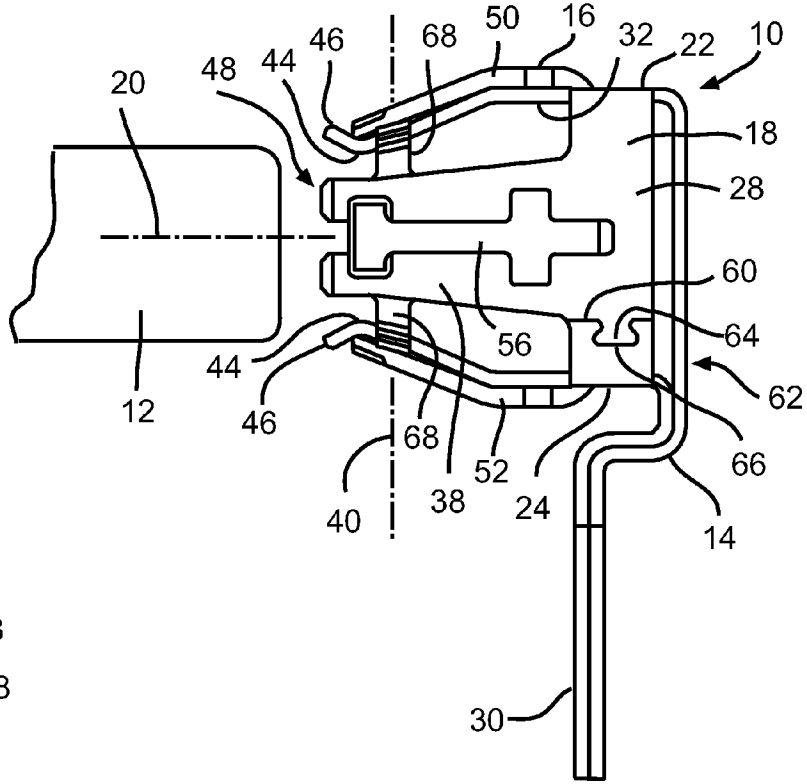
FIG. 4 is a side elevational view of the female electric connector from FIG. 1.

The illustrated terminal base 14 is stamped from a single piece of sheet metal and is folded into the illustrated shape. As shown in FIG. 4, the terminal base 14 includes two edges that meet at a seam 60. The terminal base 14 includes a lock, indicated generally at 62, at the seam 60. The lock 62 includes a tongue 64 that engages a groove 66. The lock 62 helps maintain the box shape of the terminal body 18 and resists deformation of the terminal base 14 when the male pin terminal 12 is mated with the female electric connector 10. It should be appreciated that the lock 62 helps prevent movement at the seam both in a direction parallel to the terminal axis 20, and in a direction perpendicular to the terminal axis 20.

Figure 3:
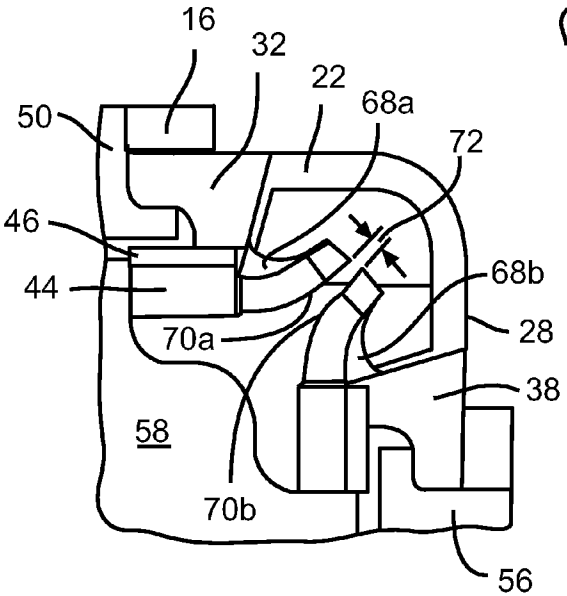
FIG. 3 is a close-up view of a portion of FIG. 2, showing the extension protection tabs.

The illustrated terminal base 14 includes optional tabs 68 that extend from the pairs of terminal arms 32, 34, 36, and 38. The tabs 68 are an over-deflection protection that limits deflection of the pair of terminal arms 32, 34, 36, and 38 in the inward direction. As previously-described, the clamp 16 serves to bias the terminal arms of the terminal body 18 in the inward direction, generally toward the terminal axis 20, thus providing a force to improve the contact between the terminal base 14 and the male pin terminal 12 when the two terminals are mated. However, it may be desirable to limit the distance that the pair of terminal arms 32, 34, 36, and 38 are deflected in the inward direction. Referring to FIG. 3, each tab 68*a* and 68*b* includes a tab engagement surface 70*a* and 70*b*, respectively. The tabs 68 are arranged in opposed pairs, with a first tab 68*a* extending from a first terminal arm 32*a* and a second tab 68*b* extending from the adjacent third terminal arm 36*b*. Respective engagement surfaces 70*a* and 70*b* are disposed generally parallel to each other, normally separated by a tab space 72. If the terminal arm 32*a* is moved in the inward direction, it will move a distance approximately equal to the tab space 72 until the tab engagement surface 70*a* of the first tab 68*a* engages tab engagement surface 70*b* of the second tab 68*b*. The second tab 68*b* will provide a force to resist further movement of the first terminal arm 32*a* in the inward direction. Similarly, it should be appreciated that the first tab 68*a* will provide a force to resist movement of the third terminal arm 36*b* in the inward direction further than a distance approximately equal to the tab space 72. The tab space 72 may be different from the size that is illustrated and may be any desired size, and the female electric connector 10 may be manufactured with the first tab engagement surface 70*a* in contact with the second tab engagement surface 70*b*, if desired. It should be appreciated that the illustrated tabs 68 do not limit the movement of the terminal arms in the outward direction, generally away from the terminal axis 20. As best seen in FIG. 2, there are opposed pairs of tabs 68 located on adjacent terminal arms 32, 34, 36, and 38 at each corner of the terminal base 14. The illustrated tabs 68 are only one type of over-deflection protection, and the over-deflection protection may be different from that illustrated, if desired.

As previously described, the male pin terminal 12 is inserted into the channel 48 when the male pin terminal 12 is mated with the female electric connector 10. To properly mate the two terminals, the centerline of the illustrated male pin terminal 12 is preferably aligned with the terminal axis 20. If the male pin terminal 12 is not properly aligned with the female electric connector 10, the male pin terminal 12 may engage one of the terminal arm ends 46 when being inserted into the channel 48. This could cause a force to push the associated terminal arm 32, 34, 36, and 38 in the inward direction, generally toward the terminal axis 20. Sufficient force applied to the terminal arm end 46 could damage the terminal arm 32, 34, 36, 38 by deforming it and bending it in the inward direction. It should be appreciated that the tabs 68 provide protection against this type of damage to the female electric connector 10.

Figure 6:
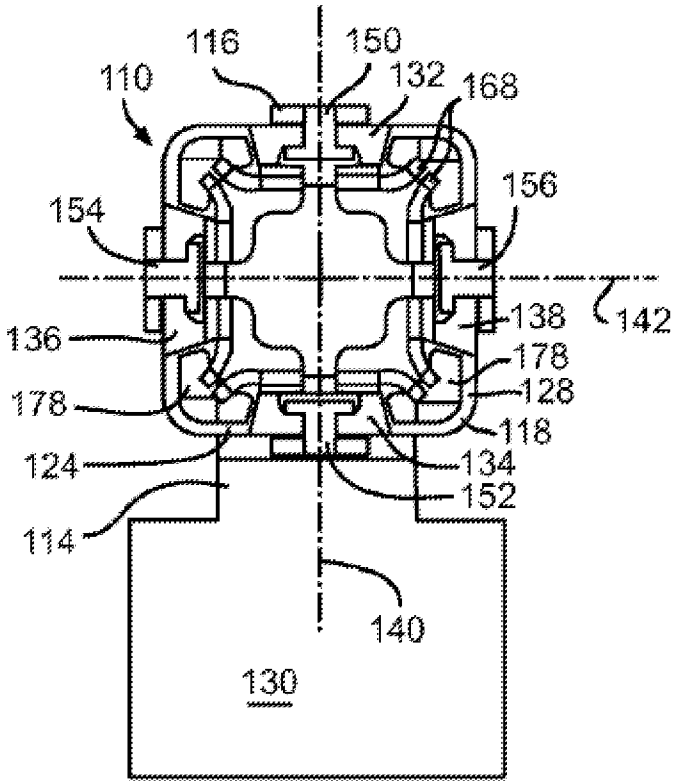
FIG. 6 is a front elevational view of the alternative female electric connector from FIG. 5.
Figure 5:
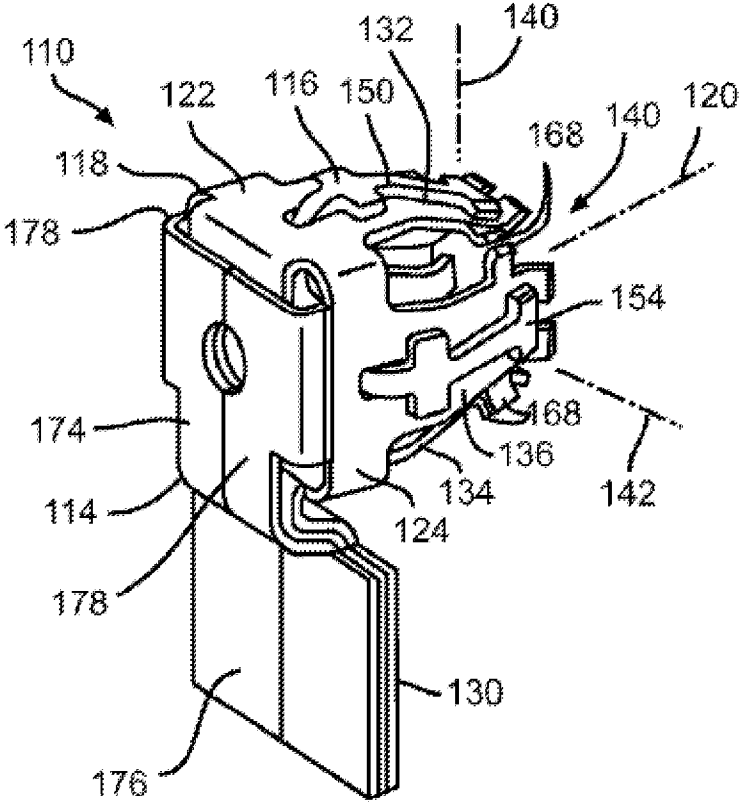
FIG. 5 is a perspective view, taken from behind, of an alternative female electric connector with extension protection tabs and an additional terminal layer.
Figure 7:
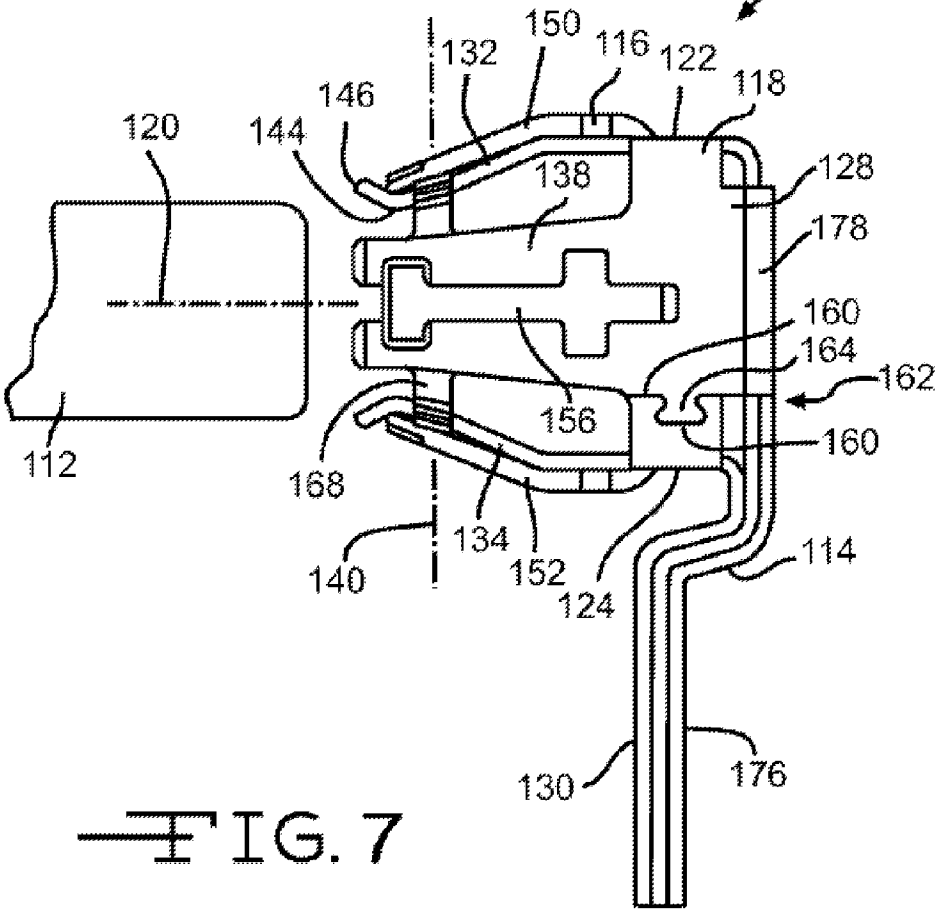
FIG. 7 is a side elevational view of the alternative female electric connector from FIG. 5.

Referring to FIG. 5, FIG. 6, and FIG. 7, an alternative female electric connector, indicated generally at 110, is shown. The alternative female electric connector 110 shares many features in common with the female electric connector 10, and similar features are identified with numbers incremented by 100. The features of the alternative female electric connector 110 that are similar to the female electric terminal 10 will not be described in detail. Similarly to the female electric terminal 10, the alternative female electric connector 110 includes a terminal base 114 that is stamped from a single piece of sheet metal and folded into the illustrated shape. However, the terminal base 114 may be made from more than one piece of material and may be made by any desired method. Further, the particular shape of the terminal base 114 may be different from that illustrated, if desired.

The terminal base 114 includes a reinforced layer 174. The reinforced layer 174 includes an extended termination area 176 and reinforced wings 178. The reinforced wings 178 extend from a terminal body 118 to the extended termination area 176. The reinforced wings 178 provide a path for electrical current to travel between a terminal body 118 and the termination area 118. This may allow the alternative female electric connector 110 to provide less resistance to current flow as compared to the female electric connector 10. It should be appreciated that this may allow the alternative female connector 110 to conduct a larger electrical current than the female electric connector 10, or allow the alternative female electric connector 110 to conduct the same electrical current while generating less heat.

Additionally, the reinforced wings 178 may provide improved structural stability to the alternative female electric connector 110 as compared to the female electric connector 10. Referring to FIG. 5, each side 122, 124, 126, and 128 of the terminal body 118 is connected to the termination area 30. Further, as seen in FIG. 7, a force applied to the alternative female electric terminal assembly 110 that attempts to cause relative movement at a seam 160 will be resisted by the reinforced wing 178.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A terminal base for a female electric connector comprising:

a substantially square terminal body having a plurality of sides that define a terminal axis; and a plurality of terminal arms each having a proximal end and a distal end, wherein:

(1) each of the plurality of terminal arms extends essentially perpendicularly from its proximal end that is attached to a respective one of the plurality of sides of the substantially square terminal body around the terminal axis, (2) each of the plurality of terminal arms is equally offset from the terminal axis such that the distal ends of the plurality of terminal arms are physically unconnected; and (3) a pair of opposed tabs extends from the distal ends of adjacent terminal arms that limit deflection of the terminal arms in an inward direction generally toward the terminal axis.

2. The terminal base for a female electric connector of claim 1, wherein each tab defines a tab engagement surface, and the tab engagement surface of a first tab is generally parallel to the tab engagement surface of a second tab.

3. The terminal base for a female electric connector of claim 2, wherein the tab engagement surface of the first tab and the tab engagement surface of the second tab are normally separated by a tab space.

4. The terminal base for a female electric connector of claim 3, wherein the tabs do not limit the movement of the terminal arms in an outward direction generally away from the terminal axis.

5. The terminal base for a female electric connector of claim 1, wherein the terminal body has a first side with a first terminal arm extending from the first side, a second side with a second terminal arm extending from the second side, a third side with a third terminal arm extending from the third side, and a fourth side with a fourth terminal arm extending from the fourth side.

6. The terminal base for a female electric connector of claim 5, wherein the terminal body is centered on a terminal axis that is located between the first terminal arm and the second terminal arm, and between the third terminal arm and the fourth terminal arm.

7. The terminal base for a female electric connector of claim 6, wherein a first opposed arm line is perpendicular to the terminal axis and passes through the first terminal arm and the second terminal arm, a second opposed arm line is perpendicular to the terminal axis and passes through the third terminal arm and the fourth terminal arm, and the first opposed arm line is generally perpendicular to the second opposed arm line.

8. The terminal base for a female electric connector of claim 5, wherein the first tab extends from the first terminal arm, and the second tab extends from the third terminal arm.

9. The terminal base for a female electric connector of claim 8, wherein the tab engagement surface of the first tab and the tab engagement surface of the second tab are separated by a tab space.

10. The terminal base for a female electric connector of claim 9, wherein the tabs do not limit the movement of the terminal arms in an outward direction.

11. A terminal base for a female electric connector comprising:

a terminal body having a plurality of generally straight sides;

a terminal arm that extends from each of the plurality of generally straight sides of the terminal body; and first and second tabs that extend from each of the terminal arms, wherein the first tab of each of the terminal arms extends parallel to and is spaced apart from the second tab of an adjacent one of the terminal arms.

12. The terminal base for a female electric connector of claim 11, wherein the terminal body has a generally square box shape.

13. The terminal base for a female electric connector of claim 11, wherein a first terminal arm extends from a first side of the terminal body, a second terminal arm extends from a second side of the terminal body, a third terminal arm extends from a third side of the terminal body, and a fourth terminal arm extends from a fourth side of the terminal body.

14. The terminal base for a female electric connector of claim 11, wherein the terminal arms extend from the respective sides of the terminal body inwardly toward one another up to respective contact areas.

15. The terminal base for a female electric connector of claim 14, wherein the terminal arms extend past the respective contact areas outwardly away from one another to respective terminal arm ends.

16. The terminal base for a female electric connector of claim 11, wherein a first pair of terminal arms extends from a first side of the terminal body, a second pair of terminal arms extends from a second side of the terminal body, a third pair of terminal arms extends from a third side of the terminal body, and a fourth pair of terminal arms extends from a fourth side of the terminal body.

17. The terminal base for a female electric connector of claim 16, wherein the pairs of terminal arms extend from the respective sides of the terminal body inwardly toward one another up to respective contact areas.

18. The terminal base for a female electric connector of claim 17, wherein the pairs of terminal arms extend past the respective contact areas outwardly away from one another to respective terminal arm ends.

19. A female electric connector comprising:

a terminal base including:

(1) a terminal body having a plurality of generally straight sides;

(2) a terminal arm that extends from each of the plurality of generally straight sides of the terminal body; and (3) first and second tabs that extend from each of the terminal arms, wherein the first tab of each of the terminal arms extends parallel to and is spaced apart from the second tab of an adjacent one of the terminal arms; and a clamp that urges each of the terminal arms inwardly toward one another.

20. The female electric connector of claim 17, wherein the clamp includes a clamp center that is located within the terminal body and clamp arms that extend from the clamp center and respective urge each of the terminal arms inwardly toward one another.

* * * * *